United States Patent [19]

Uhlmann et al.

[11] 4,368,630

[45] Jan. 18, 1983

[54] MANDREL EXCHANGE IN PIERCING MILLS

[75] Inventors: Otto Uhlmann, Burgdorf; Klaus-Peter Uhlmann, Bad Iburg, both of Fed. Rep. of Germany

[73] Assignee: Kabel- und Metallwerke Gutehoffnungshütte AG, Hanover, Fed. Rep. of Germany

[21] Appl. No.: 128,957

[22] Filed: Mar. 10, 1980

[51] Int. Cl.[3] ..... B21B 27/00; B21D 37/16

[52] U.S. Cl. ..... 72/69; 72/97; 72/201; 72/342

[58] Field of Search ..... 72/201, 209, 97, 208, 72/342, 69; 266/112

[56] References Cited

U.S. PATENT DOCUMENTS 3,747,385 7/1973 Meurer et al. ..... 72/201 X
4,242,895 1/1981 Boshold et al. ..... 72/201 X

FOREIGN PATENT DOCUMENTS 2356985 5/1975 Fed. Rep. of Germany ..... 72/201
2506418 8/1976 Fed. Rep. of Germany ..... 72/97
465239 12/1975 U.S.S.R. ..... 72/201

*Primary Examiner*—Lowell A. Larson
*Attorney, Agent, or Firm*—Ralf H. Siegemund

[57] ABSTRACT

Two water tanks, one behind the other, are disposed adjacent to the rolling gap for a piercing mill; the rolled seamless tube on a mandrel rod passes through both tanks during rolling. The tank closest to the gap contains also a mandrel holder, and following rolling the mandrel is retracted into that tank; this tank, but not the other one, is emptied and the mandrel on the rod is exchanged. The tank is refilled and the next billet can be rolled. Nozzles are provided to prevent water from escaping through openings in tank walls for the tube.

3 Claims, 2 Drawing Figures

MANDREL EXCHANGE IN PIERCING MILLS

BACKGROUND OF THE INVENTION

The present invention relates to hot-rolling (piercing) of a heated metal billet under utilization of obliquely disposed, driven rolls. The billet is rolled onto and over a mandrel on a mandrel rod, the mandrel piercing the billet for obtaining the tubular configuration.

Processes of the type above employ mandrel and mandrel rods which are to be reused. The pierced tube is stripped off the mandrel and the latter is inspected and, possibly, replaced. It is also known to introduce the rolled tube as soon as possible into a water tank for cooling. This is particularly necessary as the metal tube, as made, is usually red hot following rolling. Moreover, insertion of water is necessary to prevent oxidation of the inner and outer surfaces, for example, of copper tubing.

DESCRIPTION OF THE INVENTION

It is an object of the present invention to combine cooling and mandrel replacement functions in rolling mills for seamless tubes.

It is another object of the present invention to provide a new and improved method of exchanging mandrels in such a mill.

It is a specific object of the present invention to improve rolling mills for rolling of seamless tubes under utilization of obliquely disposed rolls which roll a round billet onto a mandrel held by a mandrel rod in the range of the rolling gap. The improvement being related in particular to madrel exchange and tube-cooling functions.

In accordance with the preferred embodiment of the present invention, the mill, as per the specific object, is improved by providing two water tanks adjacent to the rolling gap, one behind the other, and being passed through by the tube as rolled and by the mandrel rod. The tank closest to the rolling gap contains the mandrel exchange device, and that tank can and will be emptied for the exchange of mandrels; the other tank remains filled. As the tank to be emptied must have openings for passage of the tube and the rod, these openings are provided with means for preventing the discharge of water. Also, the opening in the partition between the two tanks must be blocked when the one tank is emptied for the requisite mandrel exchange.

The invention, thus, permits the exchange of the mandrels under conditions which do not necessitate an underwater exchange. The water is usually quite dirty and turbid because of scale being washed off the tube. Thus, exchanging the mandrel inside the filled cooling tank is undesirable and unreliable since fastening of the new mandrel to the rod cannot be adequately observed.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof, will be better understood from the following description taken in connection with the accompanying drawings, in which:

Proceeding now to the detailed description of the drawings, FIG. 1 illustrates a round billet 1', being rolled into a seamless tube 1 by means of obliquely positioned rolls 7. A mandrel 4 on a mandrel rod 6 pierces the billet. The tube so made passes immediately through an opening 8 into a first water-filled tank 19*a*, and from there through a partition with an opening 9 into a second water-filled tank 19. Nozzles 23 are provided at opening 8 to blow any water, tending to escape, back into the tank.

Figure 1:
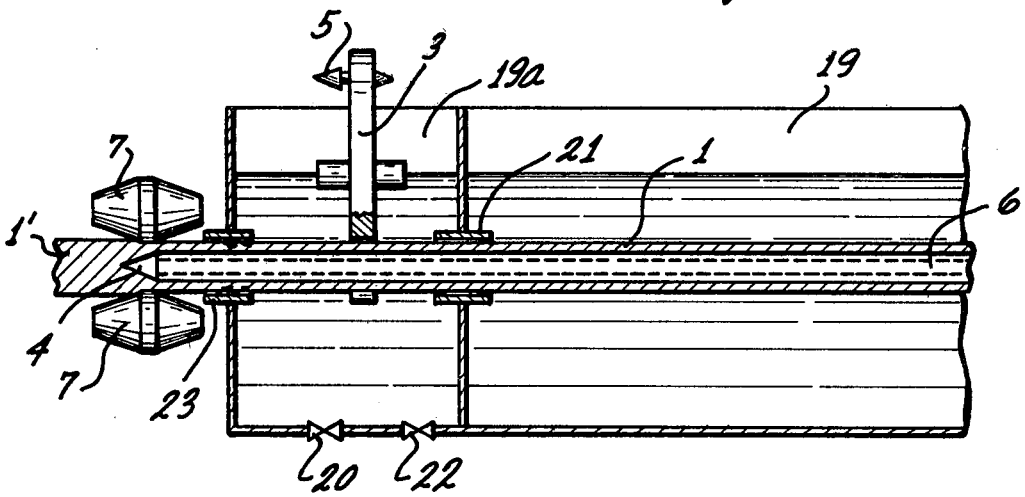
FIG. 1 is a schematic cross-section view through a mill for rolling round billets into seamless tubing, showing also tube cooling and mandrel exchange facilities; the mill is shown in particular during a rolling operation.

As schematically indicated, tube 1 passes through and clears a mandrel holder 3 which holds one or more spare mandrels 5. Holder 3 is partially submerged in the water in tank 19*a*; but a spare madrel 5, possibly having been used in a prior pass, is available for inspection and can, if necessary, be replaced by another one during the particular rolling pass illustrated in FIG. 1.

Following the completion of rolling, the tube is withdrawn and gripped by a suitable rolling device, to be stripped off the current mandrel 4. This mandrel 4 will be captured by holder 3, and the rod is disconnected from the mandrel.

Figure 2:
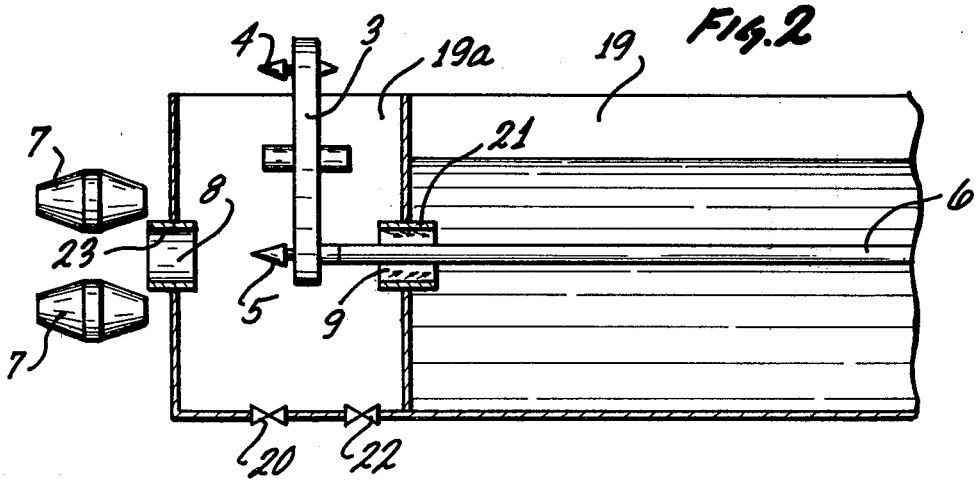
FIG. 2 shows the same mill and facilities, but during an exchange of mandrels.

In order to effect the desired mandrel exchange, nozzles 23 at opening 8 are turned on full force as the tube is being taken out of the tank 19*a*. This tank is now emptied through a discharge valve 20. A pump (not shown) may be connected for otaining speedy discharge. As can be seen from FIG. 2, a pair of nozzles 21 in opening 9 is now turned on to prevent the water in tank 19 from flowing into the other tank, 19*a*.

After tank 19*a* has been emptied, the mandrels are exchanged. The capture of mandrel 4 and its disconnection from rod 6, the turning of turret-like holder 3 to place the other mandrel, 5, into the range of rod 6, the advance of rod 6 and its connection to the new mandrel 5, are operations, all of which are carried out while tank 19*a* is empty. Mandrel 4 can now be inspected; it remains outside tank 19*a*, even after tank 19*a* has been refilled.

Following the completion of the mandrel exchange, the water is returned into the tank 19*a* via inlet valve or tap 22. Nozzle pair 21 can be turned off as soon as the water level in tank 19*a* has sufficiently risen. The next pass, i.e., rolling and piercing of the next billet to obtain another seamless tube, can now proceed.

The invention is not limited to the embodiments described above; but all changes and modifications thereof, not constituting departures from the spirit and scope of the invention, are intended to be included.

We claim:

1. In a rolling mill for rolling by piercing round billets into a seamless tube, the mill including at least two rolls, a mandrel and a mandrel rod, the improvement comprising:

a first water tank disposed adjacent to the rolls and having two aligned openings traversed by the tube as rolled as well as by the mandrel rod, the mandrel having a disposition during rolling adjacent to the rolls, external to the first tank;

a mandrel exchange device in the first tank;

means for charing and discharging the first tank with water so that upon discharge of water easy access to the mandrel exchange device is provided, permitting an exchange of mandrels;

means for preventing flow of water through said openings; and a second water tank disposed adjacent to the first water tank and also being traversed by the tube as rolled and by the mandrel rod.

2. The improvement as set forth in claim 1, the means for preventing being spray nozzles.

3. In a method of rolling and piercing round billets to obtain a seamless tube, by rolling a billet onto a mandrel, exchangeably mounted on a mandrel rod, the improvement comprising:

providing a first and a second water tank, there being a partition between the tanks, the rolled tube and the mandrel rod traversing the tanks, the first tank being disposed adjacent to a rolling gap;

filling both tanks with water to cool the tube as rolled;

emptying the first tank, but not the second tank, following completion of rolling;

placing a new mandrel into the first tank upon the completion of rolling;

exchanging the mandrel on the rod inside the emptied first tank for the new one;

removing the exchanged mandrel from the first tank; and refilling the first tank prior to rolling of the next billet.

* * * * *